United States Patent [19]

Peterson

[11] 3,948,067

[45] Apr. 6, 1976

[54] LOCKING SYSTEM FOR TWO OR MORE DOORS LEADING TO AN ENCLOSED AREA

[75] Inventor: Francis C. Peterson, St. Louis County, Mo.

[73] Assignee: C. Hager & Sons Hinge Manufacturing Company, St. Louis, Mo.

[22] Filed: May 12, 1975

[21] Appl. No.: 576,626

[52] U.S. Cl. ..... 70/263; 70/283; 292/33

[51] Int. Cl.[2] ..... E05B 65/00; E05B 63/14

[58] Field of Search ..... 70/262, 263, 264, 277, 70/279; 292/33

[56] References Cited

UNITED STATES PATENTS

| | | | |
|---|---|---|---|
| 819,208 | 5/1906 | Criqui | 292/33 |
| 1,180,123 | 4/1916 | Florcken | 292/33 |
| 1,819,410 | 8/1931 | Finkenbinder | 70/262 |
| 2,509,542 | 5/1950 | Thomas et al. | 292/33 |
| 2,726,534 | 12/1955 | Beymer | 70/263 |

*Primary Examiner*—Albert G. Craig, Jr.
*Attorney, Agent, or Firm*—Gravely, Lieder & Woodruff

[57] ABSTRACT

Two or more doors leading to a single room are provided with electrically operated locks which are energized by depressing a button in the room. All of the locks are de-energized by opening either of the doors, so that access to the room is available through either of the door openings when the room is not occupied.

10 Claims, 3 Drawing Figures

LOCKING SYSTEM FOR TWO OR MORE DOORS LEADING TO AN ENCLOSED AREA

BACKGROUND OF THE INVENTION

This invention relates to a locking system for doors, and more particularly to a system for controlling the doors to a room having one or more entries.

Due to the high cost of constructing bathrooms, it is not unusual, particularly in institutional construction, to have a common bathroom for two or more sleeping rooms with each sleeping room having its own door leading into the bathroom. This arrangement is quite often found in hospitals, nursing homes, and dormitories.

One of the major disadvantages of the common bathroom arrangement is that an individual occupying one of the sleeping rooms may, by inadvertance, deny the individual occupying the other sleeping room access to the bathroom. In particular, the individual in the first sleeping room upon entering the bathroom will most likely lock the door from the second sleeping room to gain some measure of privacy. If that individual thereafter forgets to unlock the door, the occupant of the second sleeping room cannot gain entry to the bathroom from the second sleeping room.

SUMMARY OF THE INVENTION

One of the principal objects of the present invention is to provide a system for controlling the doors at two or more entries to an enclosed area to prevent the doors from remaining locked after the area is no longer in use. Another object is to provide a system of the type stated which is ideally suited for use with a bathroom having doors leading to two or more sleeping rooms. A further object is to provide a system of the type stated which is simple in construction and reliable in operation. These and other objects and advantages will become apparent hereinafter.

The present invention is embodied in a system having electrically operated locks on at last two doors at the entries leading to an enclosed area, means for energizing the locks, and means for de-energizing locks when one of the doors is opened from within the enclosed area. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
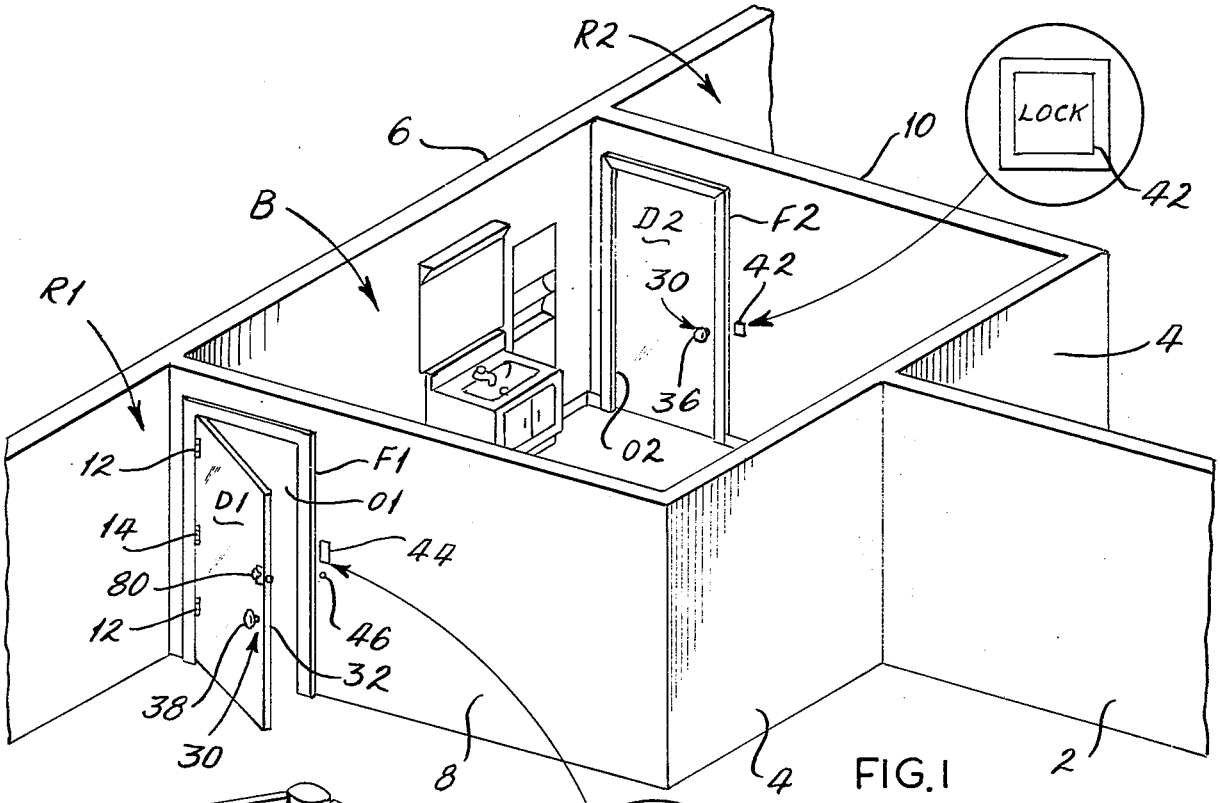
FIG. 1 is a perspective view of a room arrangement having doors secured by the locking system of the present invention.

Referring now to the drawings (FIG. 1), B designates a bathroom which serves two sleeping rooms R1 and R2 located on opposite sides of the bathroom B. Beyond the bathroom B the two sleeping rooms R1 and R2 are separated by an interior dividing wall 2 which joins a back wall 4 extended along one end of the bathroom R. The opposite end of the bathroom B is closed by a front wall 6 which is parallel to the back wall 4. The front wall 6 continues along the sleeping rooms R1 and R2 also. The sides of the bathroom B are closed by interior sidewalls 8 and 10 which are parallel and extend between the back wall 4 and front wall 6. The sidewall 8 together with the adjoining half of the back wall 4 separate the bathroom B from the sleeping room R1, whereas the sidewall 10 together with the adjoining half of the back wall 4 separate the bathroom B from the sleeping room R2.

The sidewall 8 contains a door frame F1 which defines a door opening 01 leading from the room R1 to the bathroom B. Likewise, the sidewall 10 contains a door frame F2 which defines a door opening 02 leading from the room R2 to the bathroom B. The door frame F1 supports a door D1 which swings between opened and closed positions and when closed blocks the opening 01. Similarly, the door frame F2 supports a door D2.

Each door D is supported on the hinge jamb of its frame F by a pair of conventional full mortise hinges 12 and also by a so-called contact hinge 14. The contact hinge 14 is also a full mortise hinge, but has the further capability of conducting electrical current into the door D when the door D is closed.

Figure 2:
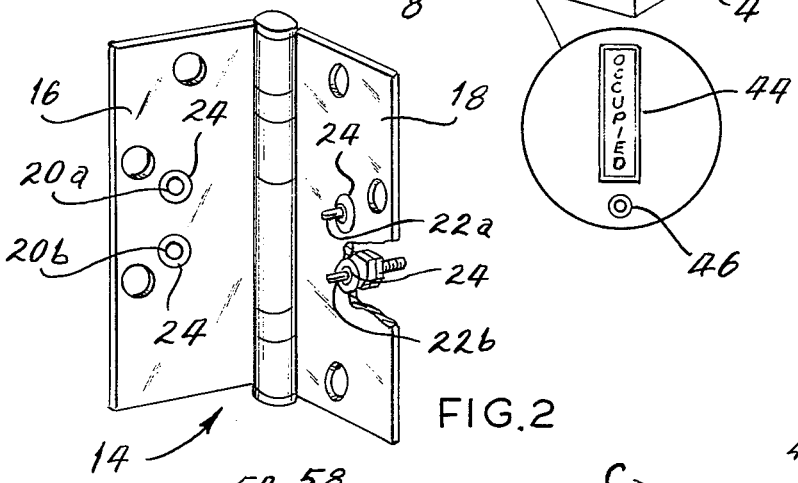
FIG. 2 is a perspective view of the contact hinges on which the doors are mounted.

The contact hinge (FIG. 2) is disclosed in U.S. Pat. No. 3,659,063, and for purposes of this discussion it is sufficient to note that the hinge 14 has leaves 16 and 18, and that the leaf 16 has two contacts 20*a* and 20*b*, while the other leaf 18 has two spring loaded contactors 22*a* and 22*b*, which align with and engage the contacts 20*a* and 20*b*, respectively, when the hinge 14 is closed. However, when the hinge 14 opens, the contacts 20 separate from their respective contactors 22. The contacts 20 and contactors 22 are set in dielectric bushings 24 which insulate them from the hinge leaves 16 and 18 and from one another. Thus, the hinge 14 when closed will complete two different electrical paths or lines.

Each door D is further provided with a lock set 30 (FIG. 1) having a latch bolt 32 which, when the door D is closed, projects into a keeper or strike on the strike jamb and secures the door D in its closed position. The lock set 80 is also provided with knobs 36 and 38 which are exposed at the inside and outside, respectively, faces of the door D, and when turned retract the bolt 32 from the strike 34 so that the door D may be opened. The lock set 30 is of the electrically operated variety in that it is provided with a solenoid 40 which, when energized, prevents the bolt 32 from being retracted by the knob 38 on the face of the door D exposed to the sleeping room R. It does not affect the knob 36 on the face of the door D exposed to the bathroom B so that the door D can always be opened from within the bathroom B. Electrically operated locking mechanisms are quite common and one suitable mechanism of this nature is disclosed in United States patent application Ser. No. 296,561 of Francis C. Peterson, filed Oct. 11, 1972, now U.S. Pat. No. 3,890,608, dated June 17, 1975, and entitled DOOR MONITORING AND CONTROLLING DEVICE FOR A SECURITY SYSTEM.

Located on the inside surface of each sidewall 8 and 10 adjacent to the strike jamb of each door frame F1 and F2, is an actuating button 42. When either actuating button 42 is depressed by someone within the bathroom B, the solenoids 40 of each lock set 30 are energized. On the opposite surface of each sidewall 8 and 10, that is, the surfaces exposed to the rooms R1 and R2, are occupied signs 44 which are illuminated when the solenoids 38 are energized, thus indicating that the bathroom B is occupied and the doors D1 and D2 are locked. Beneath each occupied sign 44 is a key operated switch 46 for de-energizing the solenoids 40 when actuated.

Figure 3:
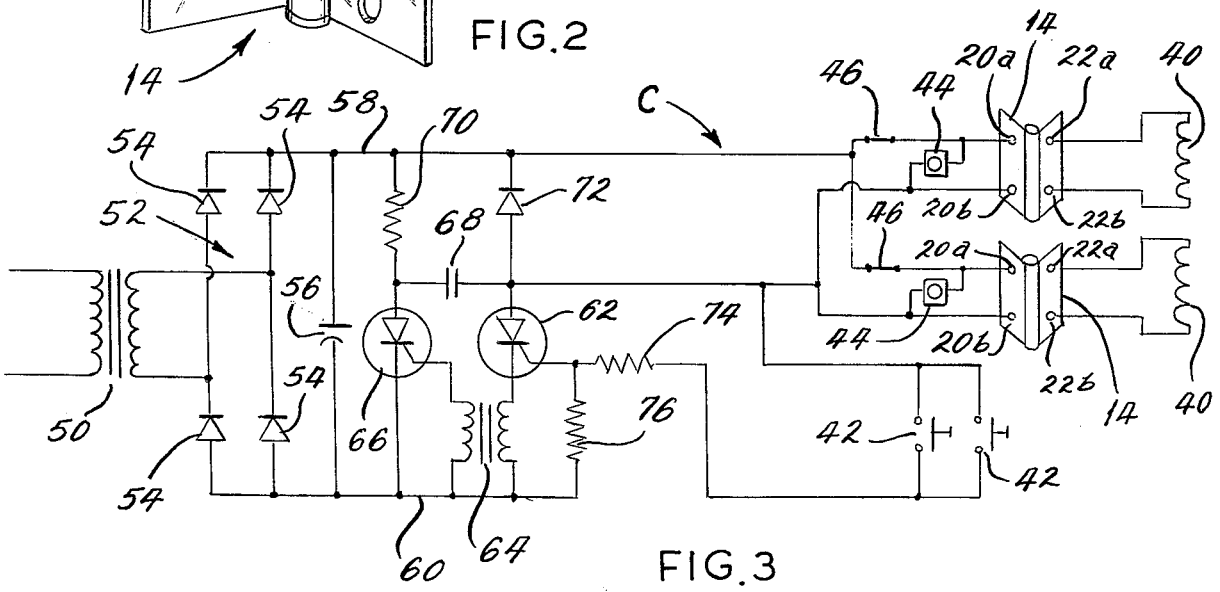
FIG. 3 is a circuit diagram of the electrical circuitry for controlling the locks.

The solenoids 40 of the two lock sets 30, the contacts 20 and contactors 22 of the contact hinges 14, the two actuating buttons 42, the two occupied signs 44, and the two key-operated switches 46 all form part of a control circuit C (FIG. 3) which energizes both the solenoids 40 of the two lock sets 30 when either one of the actuating buttons 42 is depressed and thereafter de-energizes both solenoids 40 when either one of the doors D1 or D2 is opened. The circuit C further illuminates the occupied signs 44 for as long as the solenoids 40 are energized, that is, for as long as the doors D1 and D2 are locked.

The circuit C includes (FIG. 3) a transformer 50, which reduces line voltage to 24 VAC, and a double bridge full wave rectifier 52 which converts the alternating current to direct current. The rectifier 52 has four diodes 54 which effect the actual conversion and a filter capacitor 56 which smooths out the direct current. The rectifier has two leads 58 and 60 connected to its opposite terminals and about 24 VDC exists across the leads 58 and 60.

The lead 58 is connected through the switches 46, which are normally closed, to the contacts 20*a* on the leafs 16 of the two contact hinges 14, with the contacts 20*a* being in parallel. The contactors 20*b* are connected in parallel to the anode of a silicon control rectifier (SCR) 62, while the cathode of the SCR 62 is connected to the lead 60 through the primary winding of a pulse transformer 64. The contacts 20*b* are also connected to the anode of another SCR 66 through a communicating capacitor 68. The gate of the SCR 66 is connected to the secondary winding of the pulse transformer 64 and that winding is also connected to the lead 60. Interposed between anode of the SCR 66 and the line 58 is a load resistor 70, while a diode 72 is between the anode of the SCR 62 and the line 58 to supress transient voltages.

The contacts 20*b* are further connected to the gate of the SCR 62 through the two actuating buttons 42, which are arranged in parallel, and a current limiting resistor 74. Interposed between gate of the SCR 62 and the line 60 is a bias resistor 76.

The two solenoids 40 are connected across the contactors 22*a* and 22*b* of the contact hinges 14 on their respective doors D. The lights of the occupied signs 44 are connected directly across the contacts 20 of the contact hinges 14.

To prevent the occupant of room R1 from gaining access to room R2 through the bathroom B, and vice-versa, both doors D1 and D2 may be provided with manually operated locks 80 which are operable only from the rooms R1 and R2.

OPERATION

When the occupant of the sleeping room R1 desires to use the bathroom B he enters through the door opening 01 and closes the door D1 behind him. If the door D2 is not already closed, he also closes that door. He then presses one of the actuating buttons 42 on the walls 8 or 10 to lock both doors D.

Initially, a potential of about 24 VDC exists across the leads 58 and 60 with the lead 58 being positive and the lead 60 being negative. No current flows through the leads 58 and 60 since the circuit between them is interrupted at the SCRs 62 and 66 and at the actuating buttons 42, which are normally open. However, when either one of the buttons 42 is depressed, a positive voltage is placed on the gate of the SCR 62 and this triggers the SCR 62, enabling it to conduct current from its anode to its cathode. In particular, when the button 42 is depressed, current flows from the line 58 through the contacts 20*a* and contactors 22*a* of the contact hinges 14, thence through the solenoids 40 to the contactors 22*b* and contacts 20*b* of the contact hinges 14, thereafter through the depressed actuating button 42 and resistors 74 and 76 to the line 60. The voltage across the biasing resistor 76 is enough to trigger the SCR 62 and once triggered the circuit through the solenoids 40 is completed through the SCR 62. Thus, the solenoids 40 remain energized after the button 42 is released. Of course, the energized solenoids 40 prevent the latch bolts 32 of the two lock sets 30 from being retracted by the knobs 38 at the outside faces of the doors D1 and D2. Since the lamps of the occupied signs 44 are in parallel with the solenoids 40, they are likewise energized when the solenoids 40 are energized and hence the two occupied signs 44 are illuminated.

The latch bolts 32 of the lock sets 30 remain locked until the individual opens the door D1 to go back into the sleeping room R1. In this connection, it will be recalled that the knobs 36 on the sides of the doors D1 and D2 facing the bathroom B will always retract the latch bolt 32 irrespective of the condition of the solenoids 40. Thus, the individual merely turns the knob 36 on the door D1 to release the latch bolt 32 from its strike and open the door D1.

When the door D1 opens, the contacts 20 and contactors 22 of the contact hinge 14 separate and interrupt the circuit through the solenoid 40. This unlocks the lock set 30 on the door D1 so that the latch bolt 32 can be retracted by the knob 36 on the outside face of the door D1. The isolation of the one solenoid 38 from the circuit C changes the resistance of the remaining portion of the circuit C, and this in turn results in lesser current flow through the SCR 62 and primary winding of the pulse transformer 64. The sudden change in current through the primary winding of the pulse transformer 64 induces a voltage in the secondary winding, and this induced voltage, which is in the form of a pulse, is impressed on the gate of the SCR 66, triggering it so that it conducts current from its anode to its cathode. This permits the communicating capacitor 68 to discharge through SCR 66. The discharge of capacitor 68 momentarily drops the voltage at the anode for the SCR 62 to zero, and this in turn causes the SCR 62 to shut off so that it no longer conducts current.

Of course, once the SCR 62 stops conducting current, the solenoid 40 of the closed door D2 is de-energized and unlocks the knob 38 which faces the sleeping room R2 so that the door D2 can be opened from the sleeping room R2. Thus, both doors D are unlocked.

The same sequence occurs when the bathroom B is used by the occupant of the sleeping room R2.

Whenever both solenoids 40 are energized, the doors D1 and D2 may nevertheless be opened from either of the rooms R1 or R2 by operating one of the key-operated switches 46. This interrupts the circuit C through one of the solenoids 40 and has the same effect as breaking the circuit at one of the contact hinges 14. As a result, building personnel may gain entrance to the bathroom B to assist someone who may have fainted therein or the like.

The system is suitable for use with more than two doors D. In such an arrangement, the solenoids 40 of the several doors D are all connected in parallel as are the actuating buttons 42.

This invention is intended to cover all changes and modifications of the example of the invention herein chosen for purposes of the disclosure which do not constitute departures from the spirit and scope of the invention.

What is claimed is:

1. A locking system for locking at least two doors which provide entry to an enclosed area, said locking system comprising an electrically operated lock on each door, energizing means for energizing the locks so that they lock the doors, means operable from within the enclosed area for releasing at least one of said locks, and sensing means for detecting when one of the doors opens and for deactivating the locks so that they unlock the doors when either one of the doors is opened.

2. A locking system according to claim 1 wherein the electrically operated locks are carried by the doors.

3. A locking system according to claim 2 wherein the locks have solenoids and the energizing means energizes the solenoids to lock the doors.

4. A locking system according to claim 3 wherein each solenoid is electrically isolated from the energizing means when the door carrying that solenoid is opened.

5. A locking system according to claim 4 wherein each lock has knobs exposed at both faces of the door for that lock, and the lock can be operated by both knobs when the solenoid is not energized and only by the knob exposed to the enclosed area when the solenoid is energized, the knob exposed to the enclosed area comprising said means operable from within the enclosed area.

6. A locking system according to claim 5 wherein the sensing means senses a change in current flowing through the energizing means as a result of one of the doors being opened and the consequent isolation of the lock solenoid in that door from the remainder of the energizing means.

7. A locking system for locking doors which are at multiple entries to an enclosed area, said system comprising: a lock on each door and including inside and outside handles for releasing the lock so that the door may be opened, the inside handle being at that face of the door which is exposed to the enclosed area and the outside handle being at the other face, each lock also including a solenoid which when energized prevents the outside handle on the door from releasing the lock, the solenoids of the doors being connected in parallel when the doors are closed; energizing means connected to the solenoids for supplying an electrical current and directing the current through the solenoids so as to energize the solenoids; means on each door for isolating the solenoid of the lock in that door from the energizing means when the door is opened, whereby a change in current through the energizing means occurs when one of the doors is opened; and detecting means for sensing the change of current in the energizing means and for isolating the energizing means from all of the solenoids when such a change in current is detected, whereby when one of the doors is opened all of the locks are released.

8. A locking system according to claim 7 and further comprising manually operated actuating means for causing the energizing means to energize the solenoids when operated.

9. A locking system according to claim 8 wherein the means for isolating the solenoids when the door is opened comprises a contact hinge on each door, said contact hinge having contacts and contactors which separate when the hinge opens.

10. A locking system according to claim 8 wherein the energizing means includes a source of direct current, a silicon control rectifier in series with the detecting means and with the parallel grouping of solenoids across the source of direct current; and wherein the actuating means impresses a potential across the gate of the silicon control rectifier to enable it to conduct current.

* * * * *